United States Patent [19]

Stroud et al.

[11] Patent Number: 4,945,333

[45] Date of Patent: Jul. 31, 1990

[54] FUSE ASSEMBLY, FOR A CUTOUT, WITH ACCELERATED ARC EXTINCTION

[75] Inventors: Nicholas J. Stroud, Muncie; Andrew S. Sweetana, Jr., Bloomington; Frederick J. Brown, Bloomington; Thomas P. Basa, Bloomington, all of Ind.

[73] Assignee: Asea Brown Boveri Inc., Purchase, N.Y.

[21] Appl. No.: 309,747

[22] Filed: Feb. 13, 1989

[51] Int. Cl.[5] ..... H01H 71/10; H01H 85/40

[52] U.S. Cl. ..... 337/176; 337/277

[58] Field of Search ..... 337/277, 275, 273, 177, 337/178, 176, 170, 171

[56] References Cited

U.S. PATENT DOCUMENTS 3,625,838 8/1966 Ackermann .
3,771,089 11/1973 Link .
4,220,942 9/1980 Meister et al. .
4,480,245 10/1984 Carothers et al. .
4,663,692 5/1987 Carothers et al. .

OTHER PUBLICATIONS

Westinghouse Electric Corp., Descriptive Bulletin 38-631, Jun. 1987.
Westinghouse Electric Corp., Descriptive Bulletin 38-651, Jul. 1987.
Westinghouse Electric Corp., Descriptive Bulletin 38-671, Jul. 1987.

*Primary Examiner*—H. Broome
*Attorney, Agent, or Firm*—G. H. Telfer

[57] ABSTRACT

A fuse assembly for an electrical cutout is provided with capability for rapid arc extinction by a capsule of pressurized insulating gas being located within a fuse tube above the fusible element so that when the fusible element melts and an arc is produced, gas is released from the gas cylinder that quenches and cools the arc and also assists a spring loaded flipper mechanism in expelling a lower conductor from the fuse tube.

7 Claims, 5 Drawing Sheets

FUSE ASSEMBLY, FOR A CUTOUT, WITH ACCELERATED ARC EXTINCTION

BACKGROUND AND SUMMARY OF THE INVENTION

This invention relates to fuse assemblies in electrical protective equipment such as fuse cutouts and, particularly, to such devices for relatively high voltages and currents.

A cutout is a device to isolate distribution circuit branches. It includes a conductor with a fuse in series with an individual circuit branch so that a fault on that branch will cause operation of the fuse without affecting other parallel branches. Representative examples of available cutouts are contained in Westinghouse Descriptive Bulletins 38-631, 38-651, and 38-671 and U.S. Pat. No. 4,480,245, Oct. 30, 1984, by Carothers et al., which are herein incorporated by reference for general structure of cutouts that may be improved in accordance with this invention.

The fuse link itself is located in a fuse assembly, that is a replaceable element of a cutout, that includes top and bottom contact assemblies and a porcelain insulator holding but electrically isolating the top and bottom contact assemblies. Many such cutouts are presently in use and it would be highly desirable if existing cutouts could accept a fuse assembly of the same size and shape but with, where desired, a higher voltage or current rating.

The problem addressed arises because existing fuse assemblies are generally restricted to being capable of interrupting currents only within a specified range. For example on 200 ampere, high voltage (27 kv and higher), distribution cutouts, problems are sometimes encountered in interrupting low currents per Test Series 5 of ANSI C37.41-1981, Table 3. This standard requires two tests using the minimum link rating (e.g., 140 k for a 200 ampere cutout) at a current (378 to 462 amperes for a 140 k link) which will melt the fuse link in approximately two seconds. On low current interruption, the interruption takes place inside a fiber tube of the fuse assembly. On high voltage (e.g. 27 kv) cutouts, the fuse link is located deep within a fuse tube. As the fuse link melts, gas is generated inside the fuse link to blow the pigtail out of the fuse tube and to interrupt the arc. However, with a long (such as 14 inches long) fuse tube for the higher voltage systems and a large pigtail for the higher current rating fuse link, the gases become stagnated inside the tube and interruption becomes extremely difficult. The physical size of the pigtail blocks the gases from being expelled easily and also makes removal of the pigtail more difficult, even though the pigtail is usually connected to a spring loaded flipper as described in the above-mentioned Descriptive Bulletins. It is also, of course, not desirable to have to modify the overall cutout design in order to enable the cutout to handle higher currents or voltages.

Fuse devices are known that include use of a compressed dielectric fluid for functions such as to help interrupt the current after fuse operation. These include, for example, Ackermann 3,265,838; Aug. 9, 1966; and Link 3,771,089; Nov. 6, 1973.

Ackermann presents the general object of providing a fuse construction suitable for interrupting currents over a wide voltage and current range. It utilizes the escape of a dielectric fluid from a capsule not only to effect arc extinction, but also by jet action to effect actual movement of the capsule to a remote position. This produces rapid separation of the fuse terminals and also, where desired, unlatches an associated dropout mechanism. The embodiment of Ackermann, FIGS. 3–5, includes a gas cylinder 8 having a tubular blast tube 7 extending to a point at the lower end of the fuse assembly in which the fuse link 10 is located, as depicted in FIG. 3 of the patent to Ackermann. In FIG. 4 is shown the structure after the fuse has started to burn through and the gas cylinder and blast tube have started to elevate. In FIG. 5 is shown the result after the dropout actuating pin protruding from the gas cylinder has extended through the top of the fuse assembly to enable the dropout mechanism.

In the Link patent, FIG. 1, a fluid 24 in a gas cylinder 32 is released upon burn through of the fuse link 22. The fluid is released into a space defined by arc chutes 38 and is there confined.

The present invention takes advantage of the arc extinction and contact separation capabilities of a pressurized gas cylinder in a manner that allows direct replacement of the instant invention fuse link for those formerly used without gas cylinders and with increased voltage and current rating capability.

In particular and by way of example, the fuse assembly includes within an exterior enclosure, such as of impregnated fiber glass, an interior fiber tube or liner, preferably containing arc extinguishing materials released upon fuse operation. A fuse link has on one side of it a conductor, such as one including a rigid conductive connector and a stranded copper pigtail in series, joined at one end (such as the lower end) to a spring loaded flipper element. The fusible element is connected from the connector to a conductive insert that sits on top of the interior fiber tube. There is also a strain element connecting the connector and the insert so that the assembly is held in place absent operation of the fuse.

A gas capsule, cylinder, or cartridge containing a pressurized insulating gas such as $CO_2$ or $SF_6$ is located in the upper portion of the fuse assembly. It rests against the conductive insert and at the top is secured by a spring between the top of the cartridge and a cap that closes the tube. When the fuse link melts, the lower tip of the cartridge burns through. This releases the gas into the arc area, extinguishes the arc and expels hot conductive gases out of the lower end of the tube. The melting of the fuse link also releases the strain element by melting it and causes the spring loaded flipper element to pull out the stranded pigtail and connector, thus further accelerating arc extinction.

THE DRAWING

PREFERRED EMBODIMENTS

Figure 1:
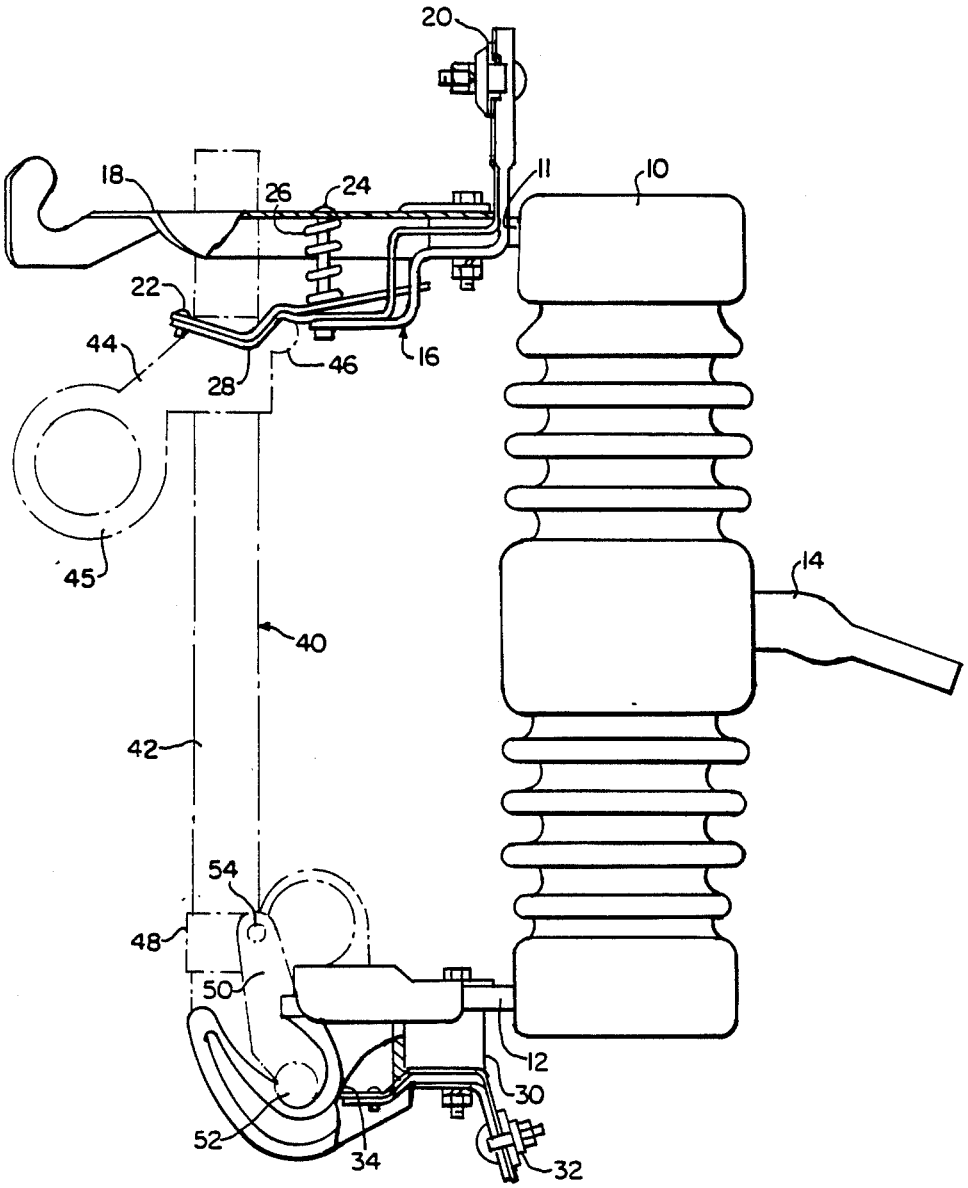
PRIOR ART FIG. 1.
FIG. 1 is an elevation view of a fuse cutout in accordance with the prior art which is to be improved in accordance with the present invention.

Referring to FIG. 1, there is a general overall view of a fused electrical cutout in accordance with the prior art to be improved in accordance with the present invention. The illustrative cutout has features generally in accordance with the above-mentioned patent 4,480,245. A porcelain insulator 10 has extending from it a rod 11 at the top, a rod 12 at the bottom and also has a bracket 14 extending from the back for attachment to a support. A top bracket 16 and top hood 18 are fastened together onto the top rod 11. The top bracket 16 has an upwardly extending portion bearing an upper terminal 20. A contact support element 22 extends over a guide post 24 outwardly from bracket 16 and is held by spring biasing of a spring 26 in the downward direction against the bracket 16 while being guided and aligned by the post. A contact 28 is located on the underside of the contact support 22 and is conductively connected to terminal 20.

At the bottom joined to rod 12 is a bottom bracket 30 to which is secured a bottom terminal 32 conductively connected to a contact 34 supported on the bracket 30.

In FIG. 1 a fuseholder or fuse assembly 40 including its associated hardware is shown in a dot-dashed line to distinguish it from the elements affixed to each other in the rest of the cutout.

The fuse assembly 40 has a fuse tube 42 containing the fusible conductor as will be described more fully below. A top ferrule 44 is secured on the top of the tube 42 with conductive connection, not shown, to the fusible conductor in the tube and to the contact 28 by a contact rod 46 that extends through an aperture in the ferrule assembly. The circular element 45 is used for opening or closing the cutout with a hookstick or using a "load-buster" tool for opening under load. The conductive path at the top if from terminal 20, through a contact strip 28 to contact rod 46, through conductive material of the top ferrule 44 to an internal conductor in the tube 42.

Near the bottom of the fuse tube 42 is a bottom ferrule 48 that extends around the tube. Ferrule 48 has joined to it a hinge assembly 50 that includes a contact rod 52. Circular element 52 is a trunion that allows the fuseholder to rotate freely in the bottom support casting. The conductive path at the bottom is from the terminal 32 through contact 34 and ultimately to the fuselink. Rod 52 has secured to it an end, not shown, of the fusible conductor extending from within the tube 42. The hinge assembly 50 pivots at point 54 and serves to support a spring, supported on another pin (not shown), of the spring loaded flipper. A fuse holder 40 containing a fuse link has upper and lower contact assemblies.

Figure 2:
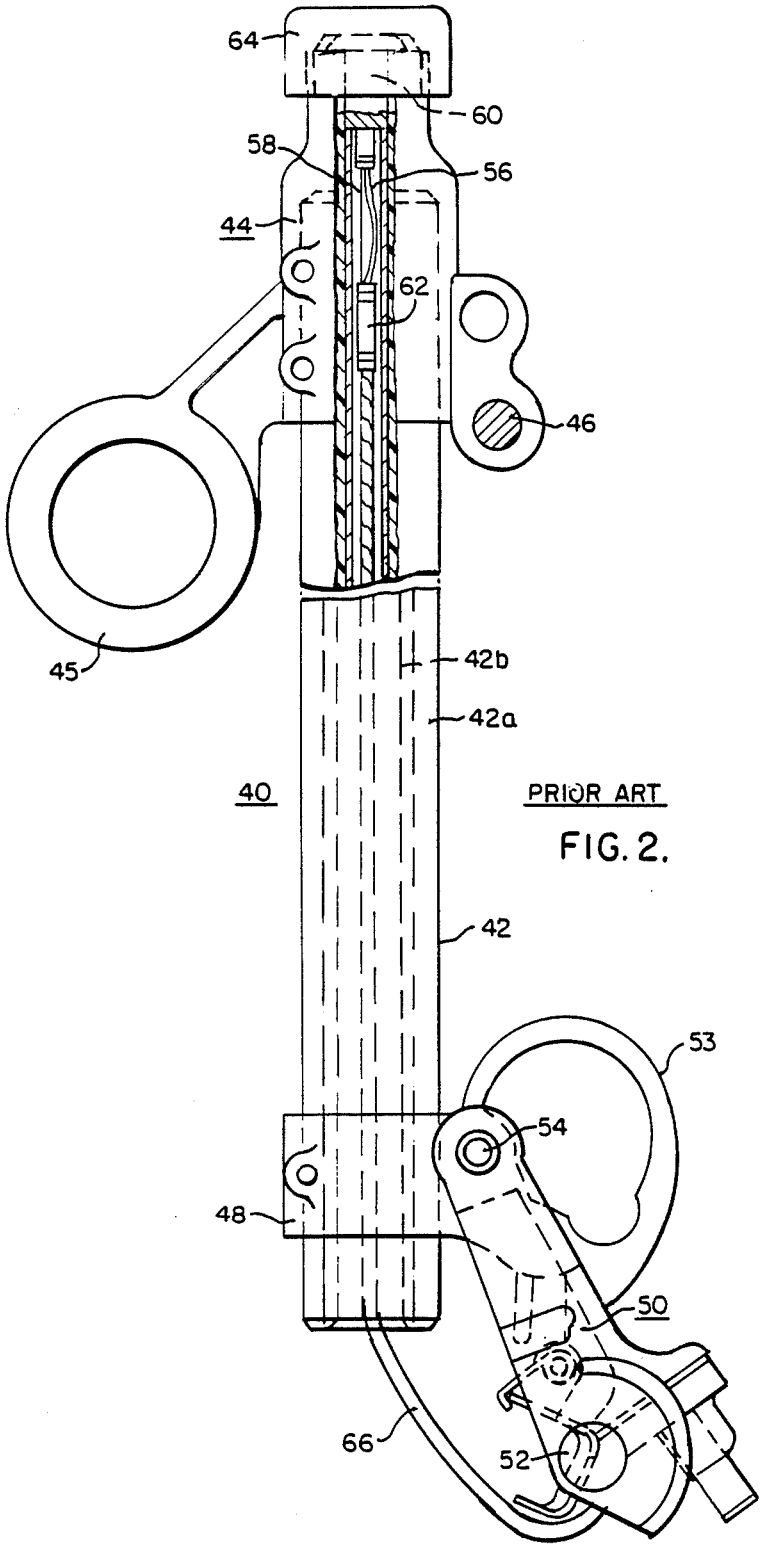
PRIOR ART FIG. 2.
FIG. 2 is a view, partly in cross-section, of a fuse assembly of a cutout in accordance with the prior art.

The fuse assembly 40 is shown in more detail in FIG. 2. It comprises a composite fuse tube 42. The composite fuse tube includes a wound fiberglass outer tube **42*a*, for strength, and a liner or inner tube 42*b* of horn fiber material which contains in its natural state an arc extinguishing material. The fuse tube 42 has associated with it a top ferrule assembly 44 and a bottom ferrule assembly 48 substantially as shown in FIG. 1**.

Within the fuse tube 42 of the standard or prior art fuse assembly of FIG. 2, there is a fusible element 56 and strain wire 58 connected together between a top contact 60 and a conductive connector 62. The top contact 60 is conductively connected with a cap 64 and the rest of the ferrule assembly 44 to contact rod 46.

Conductive connector 62 is a rigid conductor that has a stranded or pigtail conductor 66, such as of copper, secured to its lower end. Conductor 66 is flexible and extends from the lower, open end of tube 42. It is joined to contact rod 52 and to a spring loaded flipper mechanism that is part of the hinge assembly 50. The spring loaded flipper mechanism has been used heretofore and will not be illustrated or described in detail. Its characteristics are that upon release of the pigtail 66 by the melting of the fusible element 56 and strain wire 58, the spring force associated with the flipper provides enough force to cause the connector and pigtail to stretch the arc rapidly down the tube and the arc to be extinguished. The fuse tube drops downwardly and the hinge assembly rotates so that the fuse tube hangs upside down and serves as a disconnect and visual indication of the blown fuse.

Figure 3:
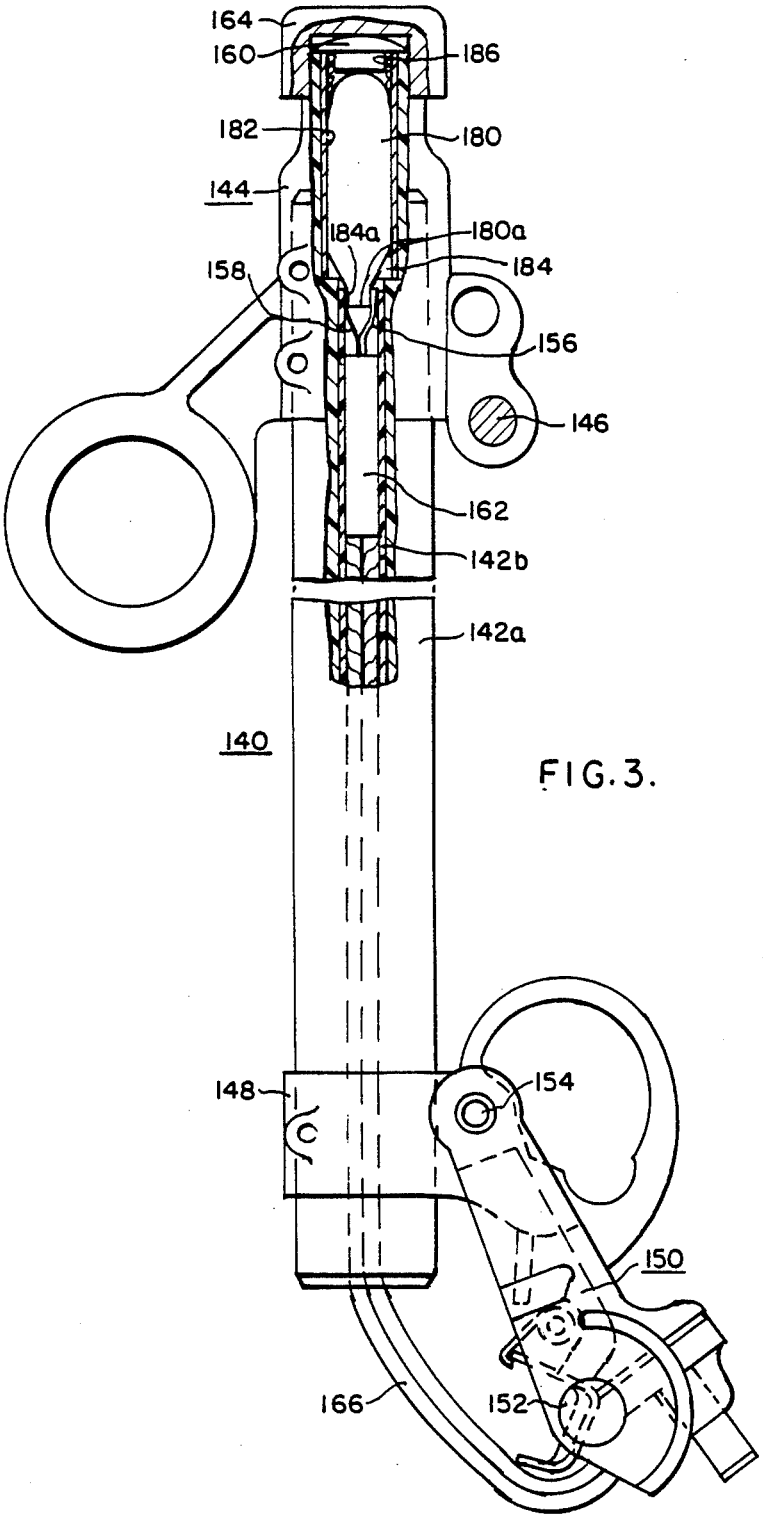
FIG. 3 is a cross-section of a fuse holder incorporating an embodiment of the present invention.

In contrast with the prior art as just described, and referring to FIG. 3, there is shown an embodiment in accordance with the present invention in which a fuse holder 140 has the same exterior configuration and fits within the same cutout arrangement as shown in FIGS. 1 and 2. Corresponding parts are identified by reference numerals having the same last two digits. In the embodiment of FIG. 3, an improvement is provided whereby within the upper portion of the fuse tube 142, there is located a gas filled capsule or cartridge or cylinder 180, such as one containing $CO_2$ or $SF_6$. The gas filled capsule 180 is located within a conductive tube such as of copper that helps insure good electrical continuity. The copper tube is in conductive relation with a conductive insert 184 that is in turn supported by part of the inner fiber tube or liner. The fusible element 156 and strain element 158 are joined to the conductive insert 184 and to a conductive connector member 162 located below them. The conductive connector member 162 also is joined to a stranded pigtail conductor 166 extending out of the bottom of the tube 142 to a spring loaded flipper device of the hinge assembly 150 which latter features are as provided in the prior art construction.

In this embodiment, both the conductive tube 182 and the insert 184 rest on the end of the horn fiber liner **142*b*. The insert 184 has a central aperture 184*a* through which a tip 180*a* of the capsule extends to the immediate area of the fusible element 156. At the upper end a spring 186 helps secure the capsule 180 against the cap 160. Good electrical continuity is provided from cap 160 through elements 182 and 184 to fusible element 156**.

When the fuse link or fusible element 156 melts and an arc is produced, the arc punctures the gas-filled capsule 180, such at its tip **180*a*, and results in the pressurized gas flowing into the bore of the fuse tube 142. The gas, for example, is at room temperature and exterior atmospheric pressure, of about 16 to 24 cubic feet but confined by the small capsule under a pressure of about 800 to 1200 pounds per square inch. The gas will cool and quench the arc and the gas pressure from the capsule 180 will force the stagnant ionized gas out of the bottom of the tube 142. This delays reignition long enough until the conductor 166 is pulled out of the tube 142 by the flipper mechanism. The pressurized gas also helps to expel the conductor 166 from the tube 142. Without the pressurized gas from the $CO_2$ or other gas capsule 180, the arc by-products and hot ionized air inside the tube may be stagnant and the arc may thus reignite on the next half cycle, despite the benefit of the spring flipper. The full benefit of the pressurized gas is obtained by the restraint on the capsule 180** from any appreciable movement.

Another advantage of this invention is to allow higher interrupting currents and/or higher voltage in the same cutout without modifications which would affect the lower current interrupting ratings. High current interruption is limited by the fuse tube strength and length because more gas is generated by higher currents and the gas must be expelled through a fixed diameter bore. The longer the bore, as necessary for higher voltages, the lower the interrupting current is because the gases build up too fast for the expulsion of the gases through the longer tube. This invention will allow for the higher currents to be interrupted by supplying high velocity pressurized gas to cool, calm, extinguish, and expel the ionized gas from the blown link. Thus, additional higher ratings can be offered which were not possible in the past.

Figure 4:
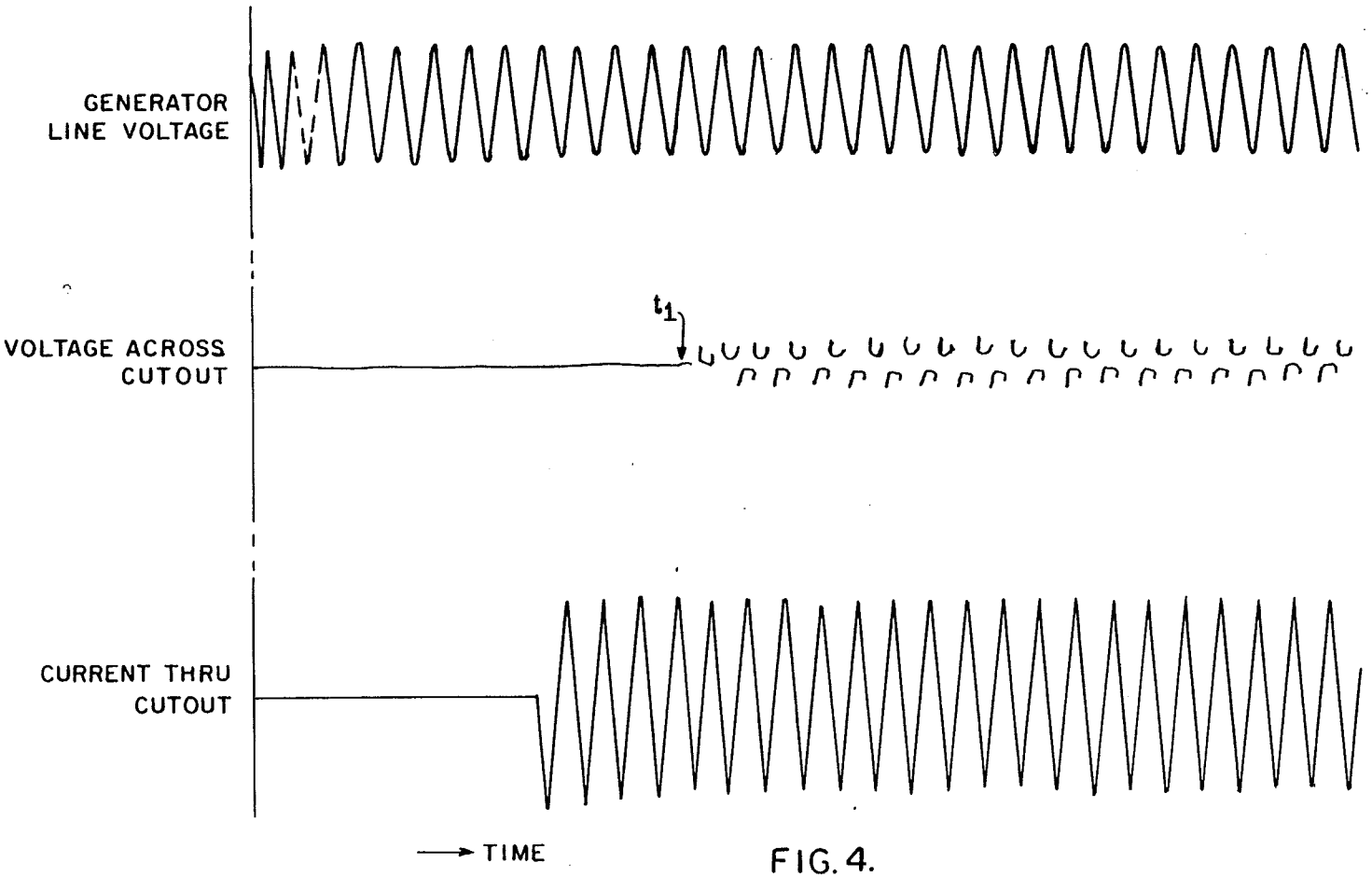
FIGS. 4 and 5 are graphs of data illustrating operation of, respectively, a fuse cutout with a fuseholder in accordance with the prior art of FIG. 2 and a fuse cutout incorporating a fuseholder in accordance with the invention as illustrated in FIG. 3.
Figure 5:
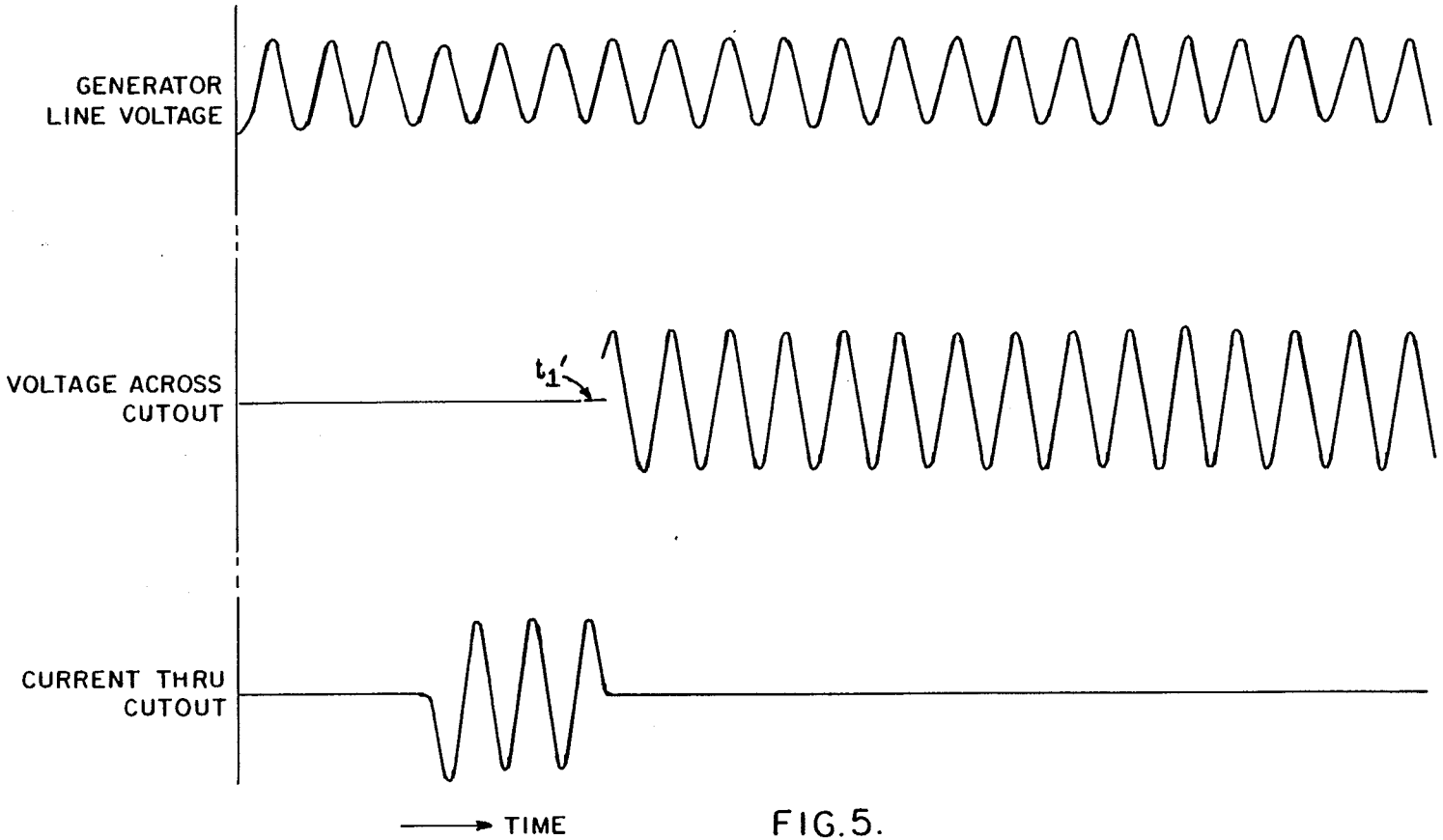

The test results shown in FIGS. 4 and 5 confirm the effectiveness of the invention. In FIG. 4, is shown the effect of operation with the conventional device in accordance with FIG. 1. Here in the top trace is a oscillogram of line voltage for a conventional 27 kv, 200 ampere fuse cutout. The middle trace shows the terminal voltage which, at a time $t_1$, shows evidence the fuse has melted but arcing has continued. In the bottom trace of FIG. 4, it is shown that current continues to flow through the device past $t_1$, indicating the fuse did not clear.

In FIG. 5, performance is shown for a device in accordance with FIG. 3. The top trace shows the line voltage as in FIG. 4. The center trace shows that at t', the fuse has melted and cleared, consistent with the lower trace which shows current flow ceases promptly after t'.

It is therefore seen that in contrast to the situation as depicted in FIG. 4, the performance of a device in accordance with the present invention, as shown in FIG. 5, results in fuse clearing and cessation of current flow within only a very short time.

It is thus demonstrated that the invention improves upon the prior art by providing a pressurized gas capsule inside a fuse tube to release an insulating gas into the fuse melting, gaseous arc area. This results in the extinction of the arc and the hot conducting gases being expelled out the tube by the pressurized gas. In addition, the pigtail lead is accelerated by the gas pressure to assist the flipper mechanism in withdrawing the lead from the tube when the fuse melts. In so doing, it is now possible to achieve higher ratings of fuse cutouts. These higher ratings permit higher voltage levels with either higher or lower current ratings than those previously used since arc extinction is dramatically improved.

It will be understood that the present invention has been described in a limited form for illustration but that it may be modified in accordance with the general teachings hereabove.

. We claim:

1. A fuse assembly, such as for a cutout, comprising:

a tube of insulating material containing a fusible element connected between first and second conductive elements, said fusible element producing an arc upon operation;

a gas capsule proximate said first conductive element and said fusible element and containing pressurized gas released by action of the arc produced by operation of said fusible element to cool and quench the arc and to force stagnant ionized gas out of said tube;

said second conductive element comprising a rigid conductor at said fusible element with a flexible conductor attached to said rigid conductor and extending from said tube;

a spring loaded flipper connected to said second conductive element that withdraws said second conductive element from said tube upon operation of said fusible element to assist further in arc extinction.

2. A fuse assembly in accordance with claim 1, wherein:

said gas capsule is located within a conductive tube on the inside of said tube of insulating material; and said insulating tube includes an outer tube of wound fiber glass and a horn fiber liner, said outer tube extending throughout the length of said fuse tube, said horn fiber liner extending from the bottom of said gas capsule through an area surrounding said fusible element; and

3. A fuse assembly in accordance with claim 2, wherein:

said first conductive element to which said fusible element is connected is a conductive insert supported against an end of said horn fiber liner;

said gas capsule is supported on said conductive insert;

a conductive cap closes an end of said insulating tube proximate said gas capsule and said gas capsule is restrained from appreciable motion between said conductive insert and said conductive cap.

4. A fuse assembly in accordance with claim 3 wherein:

said conductive insert has a central aperture through which a tip of said gas capsule extends, said tip being located in close proximity to said fusible element and being where pressurized gas is released by action of the arc.

5. A fused electrical cutout comprising:

a support insulator having at each of two spaced locations a combination line terminal and contact support for a fuse assembly; and a fuse assembly in accordance with claim 1 held in place by said contact supports at each of said two spaced locations.

6. A fused electrical cutout comprising:

a support insulator having at each of two spaced locations a combination line terminal and contact support for a fuse assembly; and a fuse assembly in accordance with claim 4 held in place by said contact supports at each of said two spaced locations.

7. A fused electrical cutout comprising:

a support insulator;

a pair of line terminals secured to spaced locations of said support insulator means for removably supporting a fuse assembly in electrical connection between said pair of line terminals;

a fuse assembly located within said means for removably supporting and comprising a fuse link between first and second conductors respectively conductively engaged with said line terminals, a gas capsule filled with pressurized dielectric gas located proximate said fuse link on one side thereof adjacent said first conductor, a spring loaded flipper connected to said second conductor on a side of said fuse link opposite to said gas capsule whereby operation of said fuse link produces an arc that ruptures said gas capsule directing pressurized dielectric gas into the arc to extinguish the arc and expel ionized gas and said second conductor, assisted by said spring loaded flipper, away from said fuse link to prevent reignition of the arc;

said fuse link being located within an insulating tube including an inner liner containing arc extinguishing material;

said first conductor, upward from said fuse link, comprising a conductive insert to which said fuse link is directly joined and also to which a strain element is joined, said conductive insert having a central aperture through which a tip of said gas capsule extends;

said second conductor, being said one opposite to said gas capsule, downward from said fuse link, comprising a connector to which said fuse link is directly joined and also to which said strain element is joined and a stranded, flexible conductor joined to said connector and also to said spring loaded flipper;

said strain element and said fuse link in combination being capable of withstanding stress induced by said spring loaded flipper, said strain element being such as to separate physically upon operation of said fuse link.

* * * * *